United States Patent [19]

Libit

[11] Patent Number: 4,460,100

[45] Date of Patent: Jul. 17, 1984

[54] REMOVABLE RESISTANT CONTAINER CAP AND NECK ASSEMBLY

[75] Inventor: Sidney M. Libit, Glencoe, Ill.

[73] Assignee: Owens-Illinois, Inc., Toledo, Ohio

[21] Appl. No.: 505,347

[22] Filed: Jun. 17, 1983

[51] Int. Cl.[3] ..... B65D 41/48

[52] U.S. Cl. ..... 215/237; 215/254; 215/256; 215/320; 215/321

[58] Field of Search ..... 215/321, 320, 237, 235, 215/256, 254

[56] References Cited

U.S. PATENT DOCUMENTS

| | | | |
|---|---|---|---|
| 2,741,388 | 4/1956 | Rubin | 215/320 X |
| 3,323,671 | 6/1967 | Minarik et al. | 215/237 |
| 3,494,496 | 2/1970 | Livingstone | 215/321 X |
| 4,303,167 | 12/1981 | Martinez | 215/256 |

FOREIGN PATENT DOCUMENTS

| | | | |
|---|---|---|---|
| 2407841 | 8/1975 | Fed. Rep. of Germany | 215/321 |

*Primary Examiner*—Donald F. Norton

*Attorney, Agent, or Firm*—Hill, Van Santen, Steadman & Simpson

[57] ABSTRACT

A container having a threaded neck is provided with a removal resistant cap which can be applied to the container neck by rotational thrust. The cap has a depending skirt having an internally threaded lower section with the threads terminating in a bead intermediate the ends of the skirt. The neck has an upper threaded section with the threads terminating in a bead spaced below the top of the neck. When the threads of the cap are engaged with the threads of the neck and the cap is rotated relative to the neck, the skirt will circumferentially expand so that the skirt bead passes over the neck bead. At that point, the threads will no longer engage and the interlocked beads will inhibit removal of the cap. Means are provided to enhance removability of the cap from the neck by tearing away a portion of the skirt.

20 Claims, 11 Drawing Figures

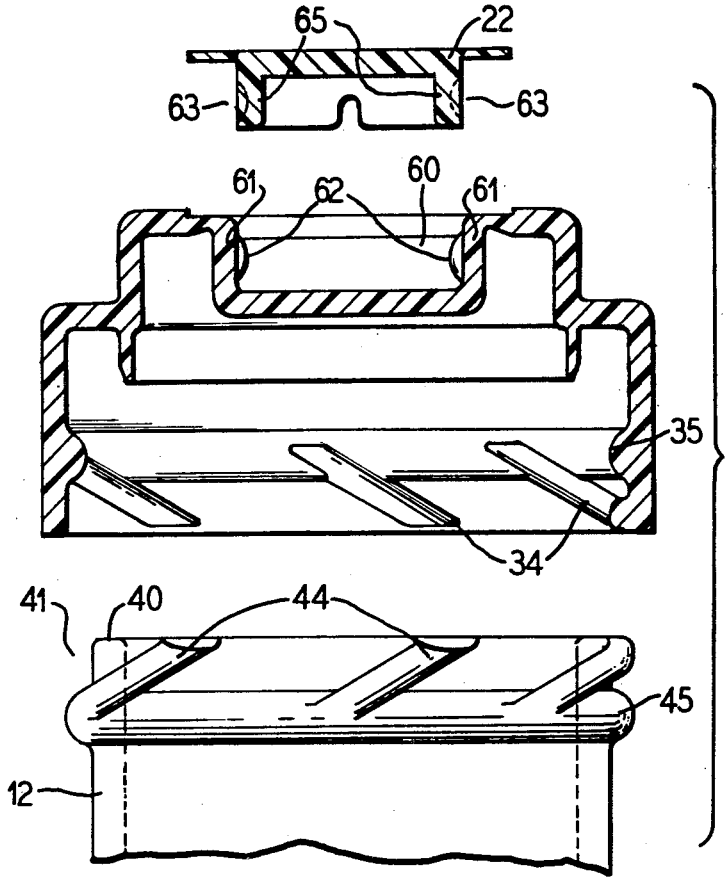
FIG. 6
FIG. 7
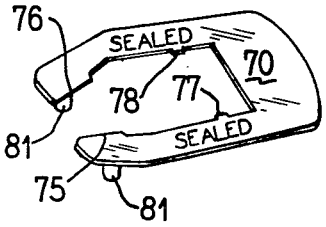
FIG. 8
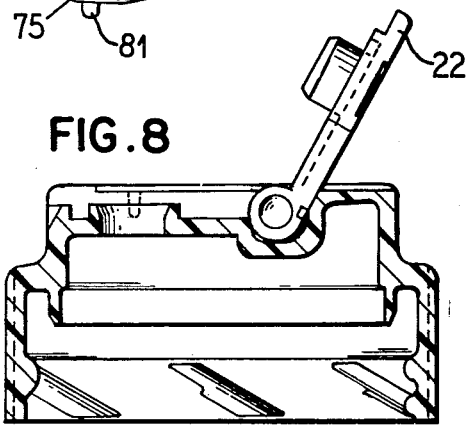
FIG. 9
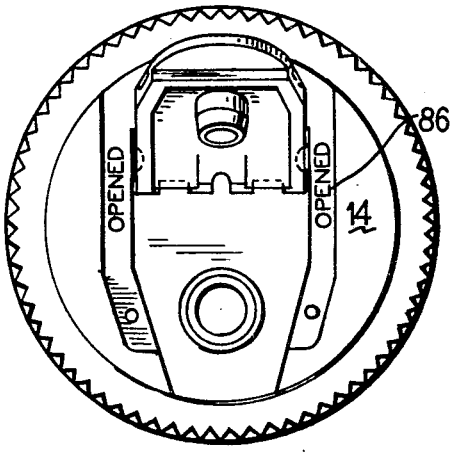

REMOVABLE RESISTANT CONTAINER CAP AND NECK ASSEMBLY

BACKGROUND OF THE INVENTION

1. Field of the Invention

This invention relates to container closures and more particularly to removal resistant container caps.

2. Prior Art

Containers are frequently provided with closure caps which are designed to be non-removable. A known form of such cap includes a depending skirt portion having an inner diameter reducing bead intermediate the axial ends of the skirt. This cap is used in combination with a container neck which has a diameter increasing circumferential bead adjacent to or slighly spaced from the throat opening of the neck. Such caps are formed of resilient material and when the cap is axially forced down over the neck of the container, the skirt will expand to allow the cap bead to pass over the neck bead. Thereafter, the resiliency of the cap will cause an interference to exist between the two beads preventing removal of the cap, it being understood that the inner diameter of the cap bead is less than the outer diameter of the neck bead. While such non-removable snap-on cap assemblies have found widespread usage in connection with caps having dispensing orifices, they present a singular disadvantage in that they require a substantial force to be applied in the direction of the container when the cap is assembled onto the container. This limits the use of such caps to those containers having substantial resistance to compression.

Although it has been known to use one way threaded connections, such connections have not generally been used in connection with overlap beads. However, threaded connections have a distinct advantage when used in capping machines in that the closure is accomplished by means of a rotational force rather than an axial force. It would therefore be an advance to provide a closure cap having an overlapped interfering bead mating with a neck bead which is applied by rotational force rather than by axial force.

Additionally, in some instances, it may be desirable to provide a non-removable cap which is, however, capable of being easily modified to provide removability. For example, in preventing alteration of goods, it is frequently desired to have a substantially non-removable cap which, however, can with application of sufficient force, be removed and which, when removed, leaves evidence of it having been removed. Such tamper evident caps, including threaded connection caps, have frequently been utilized in the soft drink industry. In such instances, there is generally provided a separable cap section which overlies an enlarged portion of the neck at the bottom of the cap skirt or, the cap itself is segmentable around the bottom. Such caps, however, in order to be replaced, must continue to rely upon their threaded connectability. Since an appreciable force is required in the original opening, and since the caps are frequently made out of thin metal, subsequent reclosure is not always effective. It would therefore be an advance to provide a plastic molded cap member having removal resistant features with means to allow ease of removability when desired.

SUMMARY OF THE INVENTION

This invention provides a container closure cap for use with necked containers. The container neck is provided with an upper portion having partial threads extending downwardly along the outer diameter of the neck which run out in a raised circumferential bead.

The container cap, in a first preferred embodiment, has a top with a depending skirt portion, the skirt portion having an inner diameter with a bottom portion consisting of raised threads which run out into a raised bead intermediate the ends of the skirt. The top portion of the inner diameter of the skirt has a diameter and axial length chosen with respect to the outer diameter of the threaded and beaded portion of the neck so as to receive the neck beaded and threaded portion freely. The raised bead on the neck has a diameter larger than the minimum diameter of the raised bead on the skirt. In this manner, when the cap is applied to the neck end and rotated, the mating raised threads on the neck and cap will cause an axial movement of the cap on the neck. The cap is formed of a resilient material allowing the skirt to circumferentially expand as the cap bead begins to engage the neck bead. By running out the threads into the beads, it will be assured that continued rotation of the cap will cause the beads to pass one another. At that point, the threads will no longer be in engagement and the neck bead will be positioned above the cap skirt bead substantially locking the cap to the neck.

In a modified form of the invention, the cap top is provided with a depending stopper or plug portion capable of substantially sealingly engaging the inner diameter throat opening of the container neck. The upper portion of the skirt from the bead to the portion of the top lying radially outwardly of the plug is dimensioned so as to provide an engagement between the top of the container neck and the undersurface of the closure when the neck bead is just beyond the skirt bead. In this manner, the resilient nature of the cap maintains a thrusting engagement at the beads which may be used to force the cap down onto the top annulus of the neck. Further, the dimension of the space between the plug and the skirt at the upper portion of the skirt can be radially substantially identical to the dimension between the inner diameter of the neck throat opening and the outer diameter of the raised threads and beads of the neck, thereby providing a container closure having an effective seal. Effective sealing can thus be obtained in spite of the fact that the threads are no longer in engagement and the cap is otherwise free to rotate on the neck.

In a further modification, the skirt can be provided with a bottom portion having means to release the anti-removal feature of the overlapped beads. In a first variation, the means can be a circumferential section of the skirt formed as a tear-away tab portion; that circumferential section including the skirt bead and threaded portion. When torn away, the remaining circumferential portions will very easily expand to allow removal of the cap. In a further variant, the entire beaded and threaded lower portion of the skirt may be removable as a tear-away strip. In either of such embodiments, the closure top portions, including the plug and unremoved skirt portion, can be dimensioned with respect to the neck so as to provide a press on type sealing cap after the non-removability feature of the skirt has been destroyed by removal of a portion of the skirt.

Further, because the skirt must have at least a portion thereof removed in order to eliminate the removal resistance feature of the overlapped beads, a tamper evident cap is thus provided. Any attempt to open the container by removing the skirt portion will immediately be evident.

It is therefore a general object of this invention to provide an improved removal resistant cap.

It is another common and more specific object of this invention to provide a removal resistant container closure for use with threaded necked containers, the closure and neck having at least partial thread extending only over a portion of their axial telescoping length with raised diameter varying members providing radial overlapping and axial abutment between the closure member and the container neck thereby resisting axial removability.

It is another and more specific object of this invention to provide a removal resistant container closure including a container cap having a skirt portion with inner diameter raised portions which interfit with container neck outer diameter raised portions to provide a screw on cap and to further provide radially overlying axially abutting projections preventing removal of the cap from the container, the cap being provided with a tear away portion in the area of the abutting parts which, when torn away, allows ease of removal of the cap from the container while providing a telltale indicia that the container has been tampered with.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

BRIEF DESCRIPTION OF THE DRAWINGS

FIG. 6 is an expanded partially sectional view of the closure cap and container neck with the section being substantially the same as the section of FIG. 4.

FIG. 7 is a perspective view of a removable portion of the spout skirt.

FIG. 9 is a view similar to FIG. 3 illustrating the cap spout in an open position.

DESCRIPTION OF THE PREFERRED EMBODIMENTS

Figure 1:
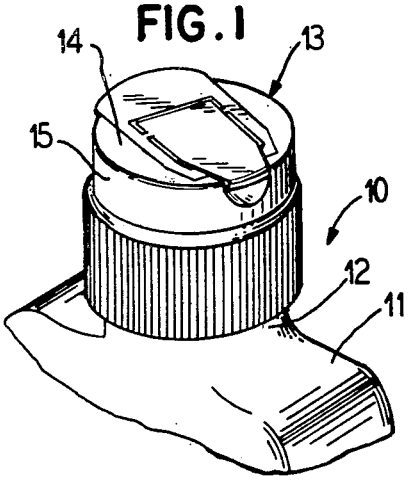
FIG. 1 is a fragmentary perspective view of a container and closure cap according to this invention.

FIG. 1 illustrates a container and closure combination 10 including a container 11 which may be of any desired shape, the container having a neck portion 12 terminating in a throat opening, the throat opening being closed by a closure cap member 13 which includes a top 14 and depending circumferential skirt 15.

Figure 2:
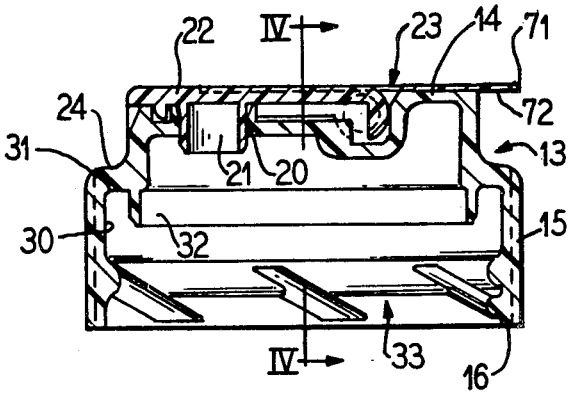
FIG. 2 is a cross-sectional view of the closure cap of FIG. 1 with the section taken longitudinally of the stopper.

As more clearly shown in the cross-section FIG. 2, the cap 13 includes a substantially elongated skirt 14 terminating in a bottom open end 16 and merging with the top 14 at the other axial end. The top may be a multi-tiered configuration as shown in the cross-section or, if desired, could be a single flat top portion. In the embodiment illustrated, the top is of the type having a pouring orifice 20 closed by a stopper 21 which is hinged closure 22, the hinged member being pivotably recieved in a socket 23 formed in the central portion of the top 14. Additionally, the top may flare outwardly as at 24 to a axially knurrled wall forming the major portion of the skirt 15.

The interior of the cup shaped cap includes an inner diameter wall 30 of the skirt 15, a container engaging undersurface 31 of the top 14, a container plug 32 and a threaded and beaded section of the skirt 33.

The threaded and beaded section 33 of the skirt inner diameter includes a plurality of partial threads 34 which extend upward from the bottom or from adjacent the bottom 16 and which run out in a diameter reducing raised bead 35. The bead is spaced intermediate the axial ends of the skirt between the container engaging undersurface 31 and the open axial end 16. Above the bead 35 the inner diameter of the skirt wall remains substantially constant at a diameter greater than the diameter of the bead. The constant diameter area 38 is dimensioned with respect to the bottle neck as is more fully explained hereafter.

The container or bottle neck 12, as most clearly shown in FIG. 6, terminates in an annular open top 40 and includes a threaded and beaded area 41 extending downwardly from the top. The threaded area includes a plurality of partial helical threads 44 which are dimensioned to properly engage the closure cap threads 34. The threads 44 run out in a circumferentially raised bead 45. The bead 45 has an outer diameter which is greater than the inner diameter of the bead 35.

Figure 5:
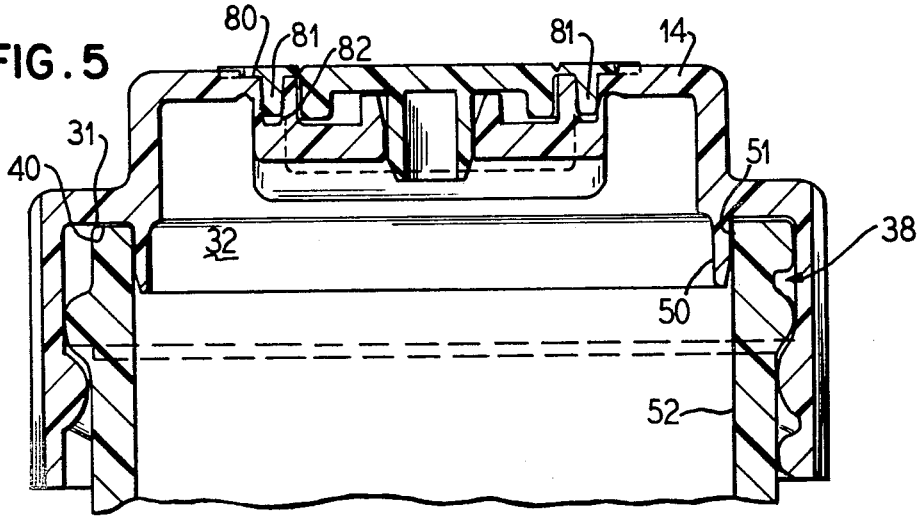
FIG. 5 is an enlarged fragmentary cross-sectional view of the closure cap and container neck taken substantially along the line V—V of FIG. 3.

The threads 34, 44, and beads 35, 45, are dimensioned such that engagement and rotation of the threads will cause the cap to be drawn downwardly onto the neck 12. Continued rotation will force the circumferential expansion of the skirt 15 of the closure cap as the top of the bead 45 engages the underside of the bead 35. Further rotation will cause the skirt to expand sufficiently for the bead 45 to pass the bead 35. The threads 34 and 44 are continued an axial distance sufficient to insure that the beads will be urged past one another or at least until the downslope on the underside of the bead 45 begins to engage the downslope on the upper side of the bead 35. At this point, the threads will run out and no longer engage one another. Due to the resilient nature of the material of the cap, which may be formed of resilient plastics, the beads will be urged past one another to the position shown in FIG. 5. In this position, the resiliency of the material of the skirt will circumferentially constrict the skirt to the point where the beads are radially overlapping and axially abutting, as shown in FIG. 5. Since the threads are no longer in engagement, and since there are no threads below the bead of the neck or above the bead of the closure cap, any further rotation, in either direction, of the closure cap with respect to the bottle neck, will not cause relative axial movement between the two.

As best shown in FIG. 5, the area 38 between the cap bead 35 and the undersurface 31, and radially between the skirt's inner diameter and the plug's 32 outer diameter, is preferably dimensioned with respect to the radial thickness of the container neck and the axial length of the container neck from the bead 45 to the annular open end 40 to provide a snug fit for sealing purposes. It will be appreciated that, in those embodiments where complete circumferential beads 35 and 45 are used, that by dimensioning the axial length of the space 38 so that the top 40 of the neck engages the undersurface 31 of the top when the beads 35, 45, are in axial abutment, that both a seal will be formed between the undersurface 31 and the top 40 and a secondary seal will be formed at the bead engagements.

In certain embodiments, however, it may be desirable to use less than circumferential beads in order to provide the axial abutment of radially overlapped members. For example, if the threads 34 of the cap are formed with abutting top end portions, the threads tops may themselves act as the abutment member for engagement with the undersurface of a container neck bead. In such instances, it may be desirable to make the container neck bead somewhat flattened on its undersurface to provide a secure abutment. In those instances, a circumferential seal will not be provided at the bead but a circumferential seal may still be provided at the engagement between the undersurface 31 and the top 40.

Moreover, sealing of the container can be enhanced by use of the plug 32. In the embodiments illustrated, the plug 32 consists of a depending axial wall 50 having an outer diameter 51 substantially equal to the inner diameter 52 of the container neck. As is known, such plugs may be force fit utilizing the resiliency of the plastic of the cap to allow a slightly oversized plug outer diameter 51 to be forceably insertable into the throat of the neck. Additionally, as is known, the plug outer diameter may be provided with individual sealing ribs or other sealing surface configurations.

It will of course be appreciated that although in this instance a circumferential wall 50 is utilized as the plug, which depends from the central portions of the top. In other instance a solid plug may be utilized or the plug may be formed of a U-shaped cross-section convolution of the top material or otherwise. By dimensioning the space 38 radially from the plug outer diameter to the skirt inner diameter consistent with the maximum thickness of the neck of the container, which thickness will include the threads 35 which run out adjacent the top 40, it can be assured that the container will be adequately sealed.

It will be apparent from the description thus far that the container neck and closure cap described provide a substantially non-removable cap which can be applied to the container by standard capping machinery used for applying threaded caps to threaded necks. A substantial axial force during application is not necessary since the axial force required to cause the skirt to expand to allow the beads to pass one another is derived from the rotational force imparted to the cap. That rotational force is converted, in part, to an axial thrust because of the engagements of the helix threads. This allows the cap of this invention to be used in connetion with thin wall or other easily compressible containers. Once the cap is fully applied to the bottle neck with the beads overlapping as shown in FIG. 5, a substantially non-removable container closure is provided. In order for the container closure to be removed, it will be necessary to expand the skirt to where the beads are no longer in engagement. By proper choice of the skirt dimensions and materials, it can be substantially assured that, while ease of application is maintained, removal will be substantially precluded.

In those instances where the cap top has a dispensing orifice such as the orifice opening 20, and a movable member having a stopper for the orifice such as the hinged pivotable closure 22 with stopper 21, it is frequently desired to preclude tampering with the contents by means of the orifice. Moreover, the means to preclude tampering with the contents should, ideally, provide evidence of prior opening.

This invention contemplates the provision of a mechanism to limit pivoting of the orifice closure 22 in a manner to prevent opening of the orifice. The means is removable to allow opening of the orifice but, in its removed state, it provides an indicia of prior tampering. The principal indicia is the absence of the removed means. As a secondary indicia, the portion which is to be removed may overlie printed indicia stating that the container has been tampered with.

As shown in FIG. 6, the top is formed with a recess 60 molded therein having sidewalls 61 from which opposed dimples 62 project into the area of the recess 60. The dimples 62 are dimensioned to pivotably interlock with recesses 63 formed in sidewalls 65 adjacent the flange end of the stopper member or orifice closure 22. For a fuller understanding of the nature and construction of the pivotable closure member 22 and socket 60, see my co-pending allowed application for patent Ser. No. 326,416, entitled "Dispensing Type Cap Closure", filed Dec. 1, 1981, the teachings of which are herein incorporated by reference.

Figure 3:
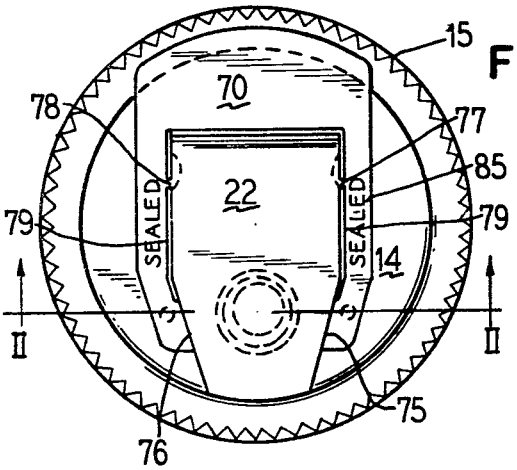
FIG. 3 is a top elevational view of the closure cap of FIG. 1.
Figure 4:
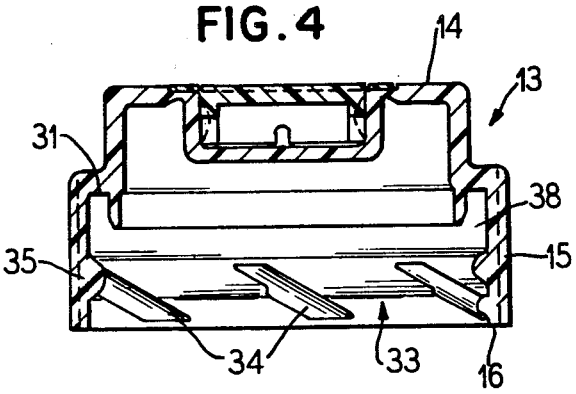
FIG. 4 is a cross-sectional view of the closure cap of FIG. 1 taken substantially along the lines IV—IV of FIG. 2.

As will be evident from FIG. 3, in connection with FIG. 2, the pivotable portion 22 overlies a central portion of the top 14 of the cap, the portion overlied may, for example, include a depressed area to allow the pivotable portion 22 to lie flush or substantially flush with the remainder of the top.

In order to prevent pivoting of the portion 22, I have provided a commonly molded flange or flat skirt member 70 which extends outwardly to the sides and to the back of the pivot portion 22 and which overlies portions of the top 14. The flange 70 may have a tail portion 71, illustrated in FIG. 2, which extends backwardly beyond portions of the top 14 to provide an overhang 72 for grasping of the tail portion from the underside.

The flange 72 is, in the preferred embodiment, integrally molded with the pivot closure portion 22 and is attached thereto at points 75 and 76 adjacent the stopper end of the pivotable closure member 22 and at points 77 and 78 adjacent to the pivot axis formed by the recesses 63. In the remaining areas, the flange may be separated from the pivot member by gaps 79.

As long as the flange 70 remains attached to the closure member 22, pivoting of the pivoting closure member 22 with respect to the top 14 will be precluded because of the inability of the flange 70 to pivot since it is in substantial surface-to-surface contact with the top 14.

In order to enhance the attachment, the undersurface 80 of the portions of the flange overlying the top 14 of the cap, adjacent the attachments 75, 76, may be provided with projecting bosses 81 which are received in bores 82 formed into the material of the cap from the top thereof. The bosses 81 may be barbed to lock into the bores, or may be otherwise affixed to the bores. The bores may be through bores with the bosses projecting all the way through to the undersurface of the cap where they could be headed by cold or not heading techniques if desired.

The principal function of the bosses is to lock the front portion of the skirt adjacent to the stopper end of the pivotable closure member 22 to the top of the cap. Because the attachment areas 75 and 76 are relatively long along the length of the member 22, a significant force will have to be applied to break the attachment of the pivotable member to the flange. By locking the flange to the cap top, it will be assured that the pivotable member 22 will not be easily openable absent prior removal of the flange 70.

The attachment point 77 and 78 may be shorter than the attachment points 76 and 75 and therefore more easily frangible. Moreover, the attachment points 77 and 78 are spaced from the tail end 71 and provide a somewhat lever type action to breaking the skirt from the pivotable member at the area 77, 78 when the tail 71 is pulled upwardly. Further pulling of the tail 71 will cause separation to occur in the areas of attachment 75, 76, thus freeing the pivotable member 22 from the flange 70. During this separation, the bosses 81 may either be pulled out of the bores 82 or may break off, remaining with the cap.

It will, of course, be appreciated that the exact extent of the attachment areas 75–78 will depend upon the material chosen and the desired force parameters for removal of the flange.

FIG. 7 illustrates the flange 70 in its removed condition with the bosses 81 remaining attached to the flange. In this instance, it will be seen that the attachment points 75–78 have been sheared from the pivotable closure member 22, which in FIG. 8 is shown in its open position.

In order to provide a readable indicia of tampering, as shown in FIG. 3, the skirt may be provided with written indicia 85 indicating that the container is sealed. The cap top 14, on the other hand, may be provided with underlying written indicia, normally covered by the flange skirt 70, indicating that the container has been tampered with. For example, the word "sealed" may be used on the flange skirt, as shown in FIG. 3 at 85, and the word "opened" provided in the underlying area as indicated at 87 on FIG. 9.

Although I have thus far shown a sealed, tamper evident substantially unremovable closure, it is frequently desired that after intentional opening by the ultimate customer, that the cap be thereafter easily removable while retaining the ability to be sealingly replaced. Such a feature can be easily provided on the cap of this invention, as more clearly shown in FIGS. 10 and 11.

Figure 10:
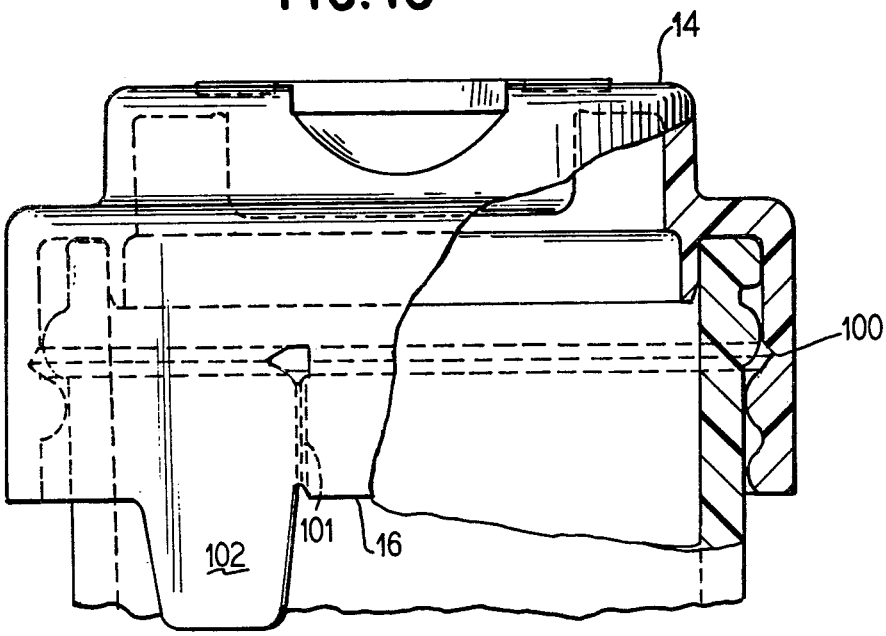
FIG. 10 is a fragmentary partially sectional view of the closure cap and container illustrating a modified form of the closure cap.

Since removability of the cap is inhibited by the overlapped abutment of the beads 35 and 45, in FIG. 10 I have provided a mechanism for removal of the cap bead 35. To this end, the cap skirt may be formed with a fracture line or circumferential weakening 100 lying above the bead. In addition, the cap skirt, in the area from the fracture line or weakening 100 axially to the end 16 may be provided with a further fracture line or weakening 101. By providing a grasping tab 102 adjacent to the fracture line 101, an easily removable tear strip results. Thus, by grasping the tab 102 and pulling it upward towards the top 14, the skirt portion will fracture along the line 101, thus breaking the circumferential integrity of the skirt. Further drawing of the tab chordally of the skirt will cause the bottom portion of the skirt to separate along the fracture line 100 around the entire circumference of the cap. After separation of the bottom portion of the skirt, including the bead 35 and partial threads 34, the radially overlapped resistance to removal provided by the beads will be eliminated, and the remaining portion of the cap can thereafter be removed from the container relatively easily. It will, of course, be understood that, if desired, the entire skirt could be removed rather than only the portion from the bead down.

However, because of the sealing nature of the plug 32, as well as the remaining upper portion of the skirt surrounding the space 38, an easily replaceable cap portion will be retained. This upper portion will maintain a sealing capability.

Figure 11:
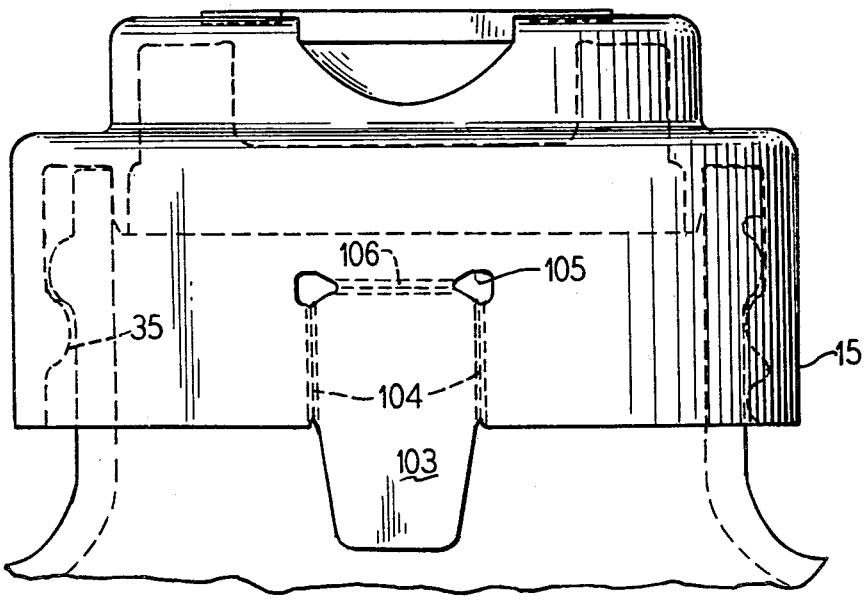
FIG. 11 is a fragmentary side elevational view of the closure cap and container illustrating another modification of the closure cap.

FIG. 11 illustrates a variant of the means for removing the non-removability feature. In this embodiment, a tab 103 is provided having parallel vertical fracture areas 104 of the skirt which extend upwardly above the bead 35 and terminate in a part circumferential fracture line 106. Thus, by pulling on the tab 103, a circumferential section of the lower portion of the skirt 15, including the bead 35 and any underlying portion of the partial threads, will be removed, thereby substantially weakening the resistance to circumferential expansion of the lower portion of the skirt. This will allow ease of removeability of the cap. If desired, to increase the removability of the tabs 102, 103, cut out portions at the intersection of the axially and circumferentially extending weakened areas can be provided as illustrated at 105. In other instances, it may not be necessary to provide the cut out areas 105.

It will be further appreciated that although FIGS. 10 and 11 show stepped tops provided with pivotable closures 22, that this removability feature may be used in connection with other cap designs including straight top closures not having pivotable members or dispensing openings.

Although the teachings of my invention have herein been discussed with reference to specific theories and embodiments, it is to be understood that these are by way of illustration only and that others may wish to utilize my invention in different designs or applications.

I claim as my invention:

1. A removable resistant container and cap assembly for use with a threaded necked container comprising: a cap having a top with a depending circumferential skirt, the skirt inner diameter having a diameter reducing circumferential bead intermediate skirt axial ends with an inner diameter threaded portion below the bead extending from adjacent an open axial end of the skirt opposite the top, the threads running out at the inner diameter bead, a full inner diameter portion extending from the inner diameter bead to adjacent the top, at least the portion of the skirt which includes the threaded portion and the inner diameter bead being circumferentially resilient, the container neck terminating in an open annular top and having an outer diameter threads dimensioned to engage the inner diameter threads of the cap, the outer diameter threads extending from adjacent the annular top towards a main body of the container, the neck having a diameter increasing outer diameter circumferential bead intermediate the main body and the annular top, the outer diameter threads running out at the outer diameter bead, the inner diameter bead having a diameter less than the diameter of the outer diameter bead, the full diameter portion of the cap having an inner diameter at least as large as the diameter of the outer diameter bead and outer diameter threads and having an axial length and diameter sufficient to receive the threaded portion of the neck and the bead of the neck between the cap top and the cap inner diameter bead and the neck having an axial portion between the outer diameter bead and main body having an axial length and outer diameter sufficient to be received within the threaded portion and inner diameter bead of the cap.

2. The combination of claim 1, wherein the cap top has a dispensing orifice therethrough and a hinge connection to a pivotable member carrying a stopper for said orifice.

3. The combination of claim 1, wherein the cap top has a depending plug portion interior of said skirt dimensioned to project into the open annular top of the neck.

4. The combination of claim 3, wherein the plug portion sealingly engages the inner diameter of the neck.

5. The combination of claim 3, wherein the neck has an inner diameter wall extending axially from the open annular top, the plug comprises a tube wall depending from the cap top radially spaced from the skirt, the tube wall having an outer diameter dimensioned to be snuggly received within the neck inner diameter wall.

6. The combination of claim 5, wherein the neck inner diameter wall is in pressed fit relationship with the tube wall.

7. The combination of claim 6, wherein the tube wall is resilient.

8. The combination of claim 7, wherein the cap top includes an undersurface portion radially between the plug and skirt engageable with the open annular end.

9. The combination of claim 8, wherein the neck has portions substantially filling the space between the plug and skirt such that a frictional resistance to removal of the cap from the neck is provided by pressured contact between the neck inner diameter and plug outer diameter and the neck outer diameter and skirt inner diameter in the area above the skirt bead.

10. The combination of claim 5, wherein the cap top includes an undersurface portion radially between the plug and skirt engageable with the open annular end.

11. The combination of claim 1, including means to separate at least portions of the skirt bead and threaded portions from the remainder of the cap.

12. The combination of claim 11, wherein the means includes a tear away section of the skirt, the tear away section including at least a portion of the bead and thread portion.

13. The combination of claim 12, wherein the tear away portion includes a projecting tab and a weakened portion of the skirt.

14. The combination of claim 13, wherein the tear away portion is a section of the circumference of the skirt.

15. The combination of claim 14, wherein the tear away portion has a projecting tab.

16. The combination of claim 12, wherein the means includes a tear away section of the skirt comprising a circumferential portion of the skirt including the bead and thread portion.

17. The combination of claim 16, wherein the tear away portion includes a projecting tab and a weakened circumferential portion of the skirt above the bead.

18. A removable resistant container and cap assembly comprising a cup shaped cap having a top and a depending circumferential skirt, the skirt inner diameter having a diameter reducing circumferential bead and partial helical threads extending from an open axial end of the skirt and running out in the bead, the container having a neck with a open annular top and a circumferential diameter increasing bead spaced from the open annular top, helical threads, dimensioned to mate with the cap threads, extending from adjacent the open annular top and running out in the bead, the neck bead having a greater outer diameter than the inner diameter of the skirt bead, the skirt being resilient, whereby the cap may be applied to the neck by relative rotational movement, engagement of the threads during relative rotational movement providing relative axial movement.

19. The assembly of claim 18, including means for removal of at least a portion of the cap bead and thread.

20. The assembly of claim 19, wherein the means includes a tear strip portion of the skirt defined by a weakened area of the skirt, the tear strip portion including a projecting tab.

* * * * *